United States Patent [19]

Sladkoshteev et al.

[11] 4,195,685

[45] Apr. 1, 1980

[54] HORIZONTAL CONTINUOUS CASTING APPARATUS

[76] Inventors: Vladimir T. Sladkoshteev, ulitsa Dzerzhinskogo, 34, kv. 11; Oleg A. Shatagin, ulitsa Melnikova, 47, kv. 9; Samuil F. Khalemsky, ulitsa Kharkovskikh divizy, 7/1, kv. 31; Viktor V. Sachko, ulitsa Danilevskogo, 10, kv. 147/148; Boris F. Abraimov, ulitsa 23 Avgusta, 47, kv. 65, all of Kharkov; Anatoly I. Manokhin, 2 Schipovsky pereulok, 8, kv. 24, Moscow; Petr P. Mishin, prospekt Lenina, 60, kv. 39, Tula; Valery P. Druzhinin, ulitsa Martenovskaya, 5, kv. 10, Tula; Leonid S. Nechaev, ulitsa Metallurgov, 3, kv. 32, Tula; Stanislav M. Kozachenko, ulitsa Slinko, 12, kv. 28; Jury M. Kuchminsky, prospekt 50-Letia VLKSM, 79, kv. 28, both of Kharkov, all of U.S.S.R.

[21] Appl. No.: 944,584

[22] Filed: Sep. 21, 1978

Related U.S. Application Data

[63] Continuation of Ser. No. 753,175, Dec. 22, 1976, abandoned.

[51] Int. Cl.[2] ..... B22D 11/08

[52] U.S. Cl. ..... 164/420; 164/440

[58] Field of Search ..... 164/420, 440

[56] References Cited

U.S. PATENT DOCUMENTS

| | | | |
|---|---|---|---|
| 3,344,845 | 10/1967 | Blessinger et al. | 164/420 |
| 3,903,955 | 9/1975 | Antoine et al. | 164/440 |

FOREIGN PATENT DOCUMENTS

| | | | |
|---|---|---|---|
| 1312243 | 4/1973 | United Kingdom | 164/440 |
| 1341041 | 12/1973 | United Kingdom | 164/440 |

*Primary Examiner*—Robert D. Baldwin

*Attorney, Agent, or Firm*—Lackenbach, Lilling & Siegel

[57] ABSTRACT

A continuous casting apparatus of a horizontal type is designed for simultaneous casting of a plurality of parallel strands from molten metal discharged from a common tundish. Each strand unit comprises a mold and a refractory conduit which are in contact with each other and in direct association with a clamping mechanism provided with means for adjusting the clamping pressure applied to said mold and conduit to enable closeness of contact therebetween. In combination with a cylinder mechanism intended for clamping conduits to a tundish, said clamping mechanisms provide for a fluid tight connection therebetween at the place of junction thereof.

6 Claims, 4 Drawing Figures

HORIZONTAL CONTINUOUS CASTING APPARATUS

This is a continuation of application Ser. No. 753,175, filed Dec. 22, 1976 now abandoned.

FIELD OF THE INVENTION

The present invention relates to casting of metals and, more particularly, to a horizontal apparatus for continuous casting of metals and alloys.

The invention is especially well suited for application in installations for horizontal continuous casting of metals and alloys which employ large-size teeming ladles.

DESCRIPTION OF THE PRIOR ART

For example, there is known in the art a horizontal continuous casting apparatus comprising a tundish and a mold connected to each other by a refractory conduit encased by a cylindrical casing (U.K. Pat. No. 1,312,243). Here, precast preparation includes the steps of clamping a cylindrical casing to the mold and then manually connecting the tundish to said cylindrical casing. Next, the whole assembly is preheated by means of a burner, and, after the mold is sufficiently heated, the molten metal is fed thereinto. Thence, withdrawal rolls are actuated to withdraw the cast ingot from the mold, said withdrawal rolls being connected with a dummy bar arranged inside the mold.

The primary disadvantage inherent in the apparatus of the patent referred to above is the unreliable connection between the mold and the cylindrical casing. As a result, a gap is formed in the process of casting between the mold and the cylindrical casing, which is due to nonuniform expansion of the materials from which said mold and casing are fabricated when subjected to heating. The cylindrical casing is also affected by the shell of the cast ingot when it is withdrawn from the mold.

The molten metal pours into the gap to solidify therein as a film in contact with the cast ingot, thus preventing withdrawal of the ingot. In the process of further withdrawal operation, the metal film or skin, solidified in said gap, is cut away and the cast section is but partially extracted. As a result, the cast ingot forms cracks and the cylindrical casing rapidly wears out. As more of the casing wears out, the wider becomes the gap between the mold and the casing, and the thicker becomes the metal skin solidified in said gap.

After the strength of an ever increasing thickness of the metal skin exceeds that of the shell of the cast ingot, the shell is ruptured and the continuous casting process is stopped.

Due to the fact that the tundish lining and the cylindrical casing itself are fabricated from refractory materials, which are not strong mechanically, and the tundish casing is not water-cooled, a gradual wearing-out of the refractory material of the cylindrical casing and that of the tundish lining is inevitable with molten metal trickling into the gap formed between said components. Furthermore, the molten metal tends to break through said gap with a resultant stoppage of the continuous casting process.

To prevent the molten metal from passing into the gap between the mold and the cylindrical casing, as well as between the tundish and said casing, it is necessary to make use of refractory coatings prepared of a mixture of aluminium and silicon oxides, mixed with water or a soluble silicate and applied to the contacting surfaces intermediate the cylindrical casing and the mold, as well as intermediate the casing and the tundish. When the aforesaid components are heated, the coating dries up to form a castable refractory which, nevertheless, is liable to destruction during continuous casing due to the insufficient engagement of said coating with the material of the cylindrical casing and that of the tundish. As a result, the molten metal is free to pass into the gap between the cylindrical casing and the mold, and into that formed between the cylindrical casing and the tundish.

The danger of a gap being formed between the mold and the cylindrical casing of the conduit on the continuous casting machines of the type described renders impossible heating of the mold separately from the rest of the machine, which substantially impairs the operating efficiency of the continuous casting process.

Therefore, consider some of the major disadvantages inherent in the construction of the prior-art continuous casting machines.

When clamping the casing of the refractory conduit to the mold, the clamping pressure is applied through the tundish casing onto the conduit casing. This clamping pressure is less than the initial one which contributes to the friction force created by a large-size tundish. Taking into account that the friction force is rather high, it is to be assumed that the pressure applied to the cylindrical casing of the conduit is insufficient to provide for tight connection between said components. If, however, the initial clamping pressure is increased, the tundish walls will be in danger of deformation and the refractory material will be in danger of destruction.

It is to be noted that in the process of operation of a continuous casting machine, the place of junction between the mold and the conduit casing is exposed to severe corrosive thermal and mechanical undesirable effects derived from the flow of molten metal. In particular, mechanical effects are created by the friction of the shell of the cast ingot when the ingot is withdrawn from the mold. The withdrawal process is not smooth but intermittent. The cast ingot is drawn in jerks, thereby resulting in loosening of the conduit casing-mold connection at the place of junction thereof.

There is no improvement to be expected when the place of contact is inclined relative to the axis of the cast ingot surface /say, cone or sphere/, since the metal tends to pass into the tapered portions, forming hard barbs that disrupt the machine operation until it fails completely.

Another disadvantage of the known horizontal continuous casting machines is that it is impossible to carry out simultaneous discharging of molten metal into a plurality of horizontally arranged molds from a single tundish. Said disadvantage stands out sharply against the recent tendency for lower working heights of continuous casting machines and transition to horizontal continuous casting installations. In the case of horizontal arrangement of said installations, there arises no need to construct either a pit or a turret for mounting the machine components which extend horizontally on the floor shop level. On the other hand, a larger capacity or size of a ladle results in a greater number of strands being cast on such type of machine. According to the known machine construction, it is impossible to provide clamping of the mold to more than two conduits. At present, an 8-strand machine is feasible, even though there is no guarantee of a reliable connection between each conduit and the mold.

It is advantageous that a common tundish be installed to serve all the strand units. It is important, therefore, that the machine of the type described be constructed so as to have all its components arranged strictly horizontally along the same axis, including the mold, the zone of secondary cooling, the withdrawal rolls and the cut-off station. The mold is not to be displaced prior to starting a new casting cycle, as this may upset the structural arrangement of the machine.

SUMMARY OF THE INVENTION

It is, therefore, an object of the present invention to provide a horizontal continuous casting machine which exhibits enhanced efficiency and is designed for application in combination with large-size teeming ladles.

Another object of the invention is to provide a horizontal continuous casting apparatus which is reliable in operation and features a stable continuous casting process.

Still another object of the invention is to provide a horizontal continuous casting machine which assures a improved surface quality of the cast ingot.

Yet another object of the invention is to provide a horizontal continuous casting apparatus whose advantages over the known machines of similar type will be attained at the expense of simple and inexpensive reconstruction of the latter.

It is likewise one of the objects of the invention to provide a horizontal continuous casting apparatus which is simple in operation, said machine featuring, from the technological point of view, improved serviceability.

These and other objects and features of the invention are attained in a horizontal continuous casting apparatus comprising, mounted successively on a frame, a tundish into which a molten metal is teemed, refractory conduits arranged horizontally at the outlets of said tundish, horizontal molds, and withdrawal rolls adapted to withdraw solidified cast ingots from said molds. The tundish is movable along the frame relative to the fixed molds and is clamped to the molds with a given pressure. According to the invention, the tundish is made as an elongated vessel formed with a plurality of outlet openings for discharging therethrough parallel flows of molten metal to be cast, said openings each having fitted thereto a separate strand unit consisting of a refractory conduit and a mold. Each of said strand units is provided with a clamping mechanism associating on one end with the mold and on the other end directly with the conduit, said clamping mechanisms each being provided with a means for adjusting the clamping pressure applied to the conduit and to the mold to assure fluid-tight connection therebetween.

Such a constructional arrangement allows for a plurality of strands to be cast simultaneously as the molten metal is discharged into a plurality of molds from a common tundish. Due to the direct association between the clamping mechanisms and the conduit, it is possible to provide for far more effective clamping of the conduits to the molds and to eliminate the possibility of the molten metal passing into gaps and the formation of metal barbs. It is likewise possible to adjust the clamping pressure in dependence with the state of contacting portions of the machine components, each strand unit being provided with an individual clamping pressure adjusting mechanism. In the known technique of clamping, which is effected by the application of pressure through the body of a tundish, the clamping pressure is restricted by the strength of the tundish body. Therefore, the application of clamping pressure in the aforesaid direction failed to provide for effective clamping of the conduit to the mold. It is apparent to those skilled in the art that it is far more reliable to ensure fluid-tight connection between the surfaces of directly adjoining components rather than between those having clamping pressure applied thereto through intermediate components, such as a tundish, which are quite cumbersome, heavy and unstable.

In accordance with the present invention, there is proposed a horizontal continuous casting apparatus wherein a clamping mechanism comprises a plurality of clamping or strengthening rods in parallel arrangement with each other and which extend away from a mold towards a conduit, and a ring formed with holes, clasping externally the conduit casing fitted with an outwardly protruding shoulder, said ring thrusting up thereagainst, and mounted on the ends of the rods through said holes thereof.

Such clamping mechanism construction is best suited to enable uniform and adjustable clamping of the tundish end surface to the outlet opening of the mold. The clamping mechanism of this type is adaptable to various changes in the state of the contacting surfaces of the mold and the tundish, and is operable to adjust the clamping pressure, thereby enabling fluid-tight connection and eliminating the possibility of a gap between said contacting surfaces of the machine components.

In another embodiment of the present invention, the means for adjusting the clamping pressure comprises a plurality of cotters which are fitted into elongated slits provided on the ends of parallel rods of a mold and adapted to shift a conduit through said ring towards the mold.

In this case, the aforesaid clamping pressure adjusting means is made as an adjuster cotter.

In still another embodiment of the invention, a ring with holes therein is rigidly connected with a central cone-shaped sleeve snugly fitted on the tapered outer surface of the conduit casing and which serves as a distance piece between a mold and a tundish, said sleeve flaring towards the mold.

The aforecited modification of the invention is advantageous in that the provision of the tapered sleeve or distance piece prevents undesirable destruction of the conduit casing, fabricated from a refractory material which is not strong mechanically, and thus contributes to a higher operating efficiency of the machine as a whole and allow for a higher clamping pressure to be applied, whereby reliable fluid-tight connection is enabled between the machine conduit and the mold.

Yet another embodiment of the invention features a clamping pressure adjusting means in the form of a screw-and-nut connection joint provided on each end of the parallel rods extending through the holes of the ring fitted on the conduit casing.

The aforesaid adjusting means are especially suited to an application where the screw-and-nut connection is technically expedient.

In another embodiment of the invention, said rods are hinged on the mold surface at prescribed points along its perimeter and are readily hinged back, thus changing the initial positions in which the rods remain in parallel arrangement with each other and with the axis of the mold, said rods being also provided with servocylinders for shifting the ends thereof relative to the face wall of the mold.

The aforedescribed structural feature renders the apparatus of the invention more convenient in operation and facilitates various reconstruction operations resorted to during the apparatus assembly, setup or repair.

In the last herein proposed modification of the invention a mold is connected to a frame through an adjustable power clamping mechanism pivotably connected with a tundish to apply thereto uniform clamping pressure whereby the tundish is pressed tight against all the conduits to the individual strand units.

The above described version of the invention provides for an improved clamping technique whereby the mold itself is clamped to the inlet openings of each conduit casing and, coupled with the aforedescribed major improvements, renders the herein proposed apparatus still more convenient to operate.

BRIEF DESCRIPTION OF THE DRAWINGS

The above-mentioned and other features and objects of this invention and the manner of attaining them will become more apparent and the invention itself will be best understood by reference to the following description of the embodiment thereof taken in conjunction with the accompanying drawings.

In the drawings.

DETAILED DESCRIPTION OF THE INVENTION

Figure 1:
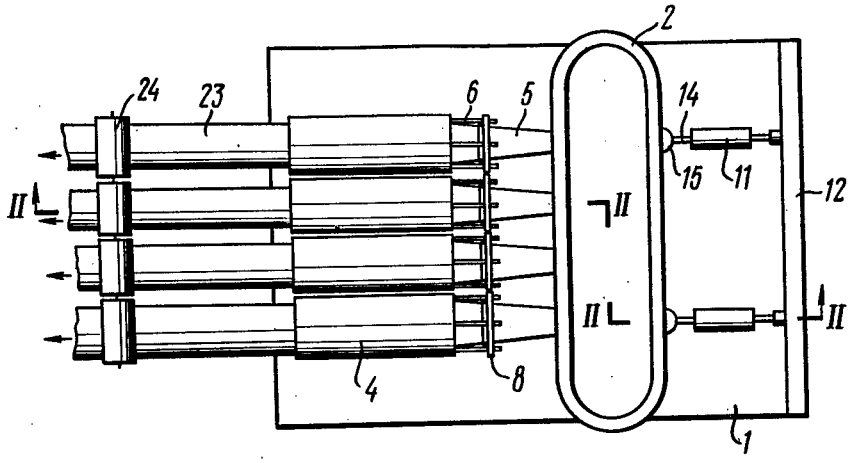
FIG. 1 is a top plan view of a horizontal continuous casting apparatus wherein molten metal is simultaneously discharged into a plurality of molds in parallel arrangement with each other, according to the invention.
Figure 2:
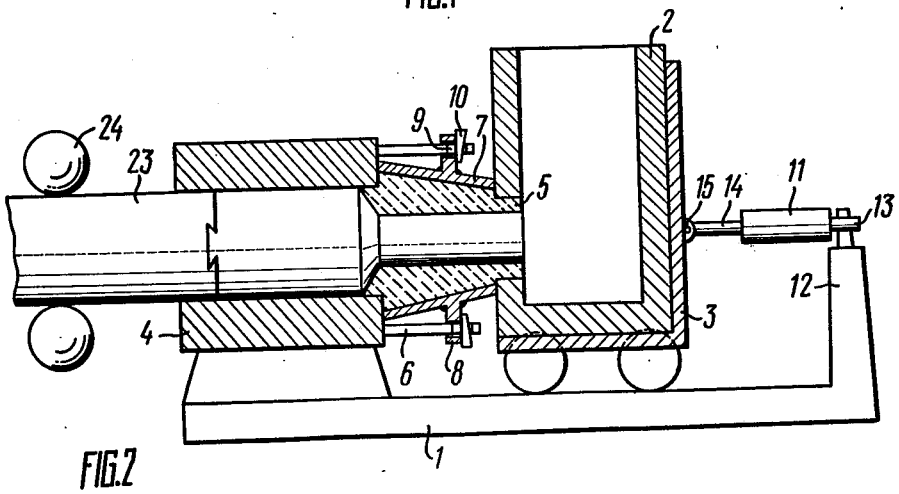
FIG. 2 is a longitudinal, side, cross sectional view taken along the line II—II of FIG. 1, wherein there is provided a distance piece or sleeve and adjuster cotter means for adjusting the clamping pressure required for clamping a conduit to a mold, according to the invention.

Referring now to the drawings, there is shown a horizontal continuous casting apparatus which comprises a framework or frame 1, such as is shown in FIGS. 1 and 2, having mounted thereupon a carriage 3 which carries a receptacle or tundish 2 of an elongated curved cross-section and of an increased capacity suited for a plurality of strands to be cast. The apparatus of the invention also incorporates strand units in parallel arrangement with each other, said units each consisting of a mold 4 connected to the tundish 2 by a respective refractory conduit 5. Each conduit 5 is frustoconical in shape and flares towards the respective mold 4. Provided on each mold 4 is an individual clamping mechanism adapted to ensure fluid-tight connection between the mold 4 and its respective conduit 5. The clamping mechanism comprises parallel rods 6 which extend from the end wall of the mold 4 towads the tundish 2.

Fitted on the tapered body of each conduit 5 is a steel distance piece or sleeve 7 having fixed in its center region a clasping or strengthening ring 8, said sleeves extending from the mold 4 to the tundish 2. The clasping ring 8 is formed with holes which are disposed or located along its periphery and through which said ring is fitted on the ends of the parallel rods 6. The ring 8 is thrust by its respective centrally disposed distance piece or sleeve against the body of the conduit 5. To adjust the clamping pressure required for pressing the ring against the conduit, as well as for clamping the conduit to the mold 4, there is provided a clamping pressure adjusting means in the form of cotters 10 fitted into slits 9 made on the protruding ends of the rod 6, said cotters exerting progressively increasing pressure on the ring 8 towards the mold 4 as they move on.

At the opposite side, relative to the molds 4, the tundish 2 is clamped to the frame 1 by means of power cylinders 11, each cylinder having one end fixed to the frame 1 via a vertically disposed or bent bracket 12 formed with an articulated joint 13. Rods 14 of each power cylinder 11 are connected through articulated joints 15 with the carriage 3 and the tundish 2. The number of strand units is selected depending upon the circumstances. It is understood that the provision of individual clamping mechanisms makes it possible to provide for reliable adjustable connection between the conduit 5 and its mold 4 owing to the provision of a plurality of conduits which are in parallel arrangement with each other and fitted to a single tundish 2. The distance piece or sleeve 7 enables a far wider range of values of clamping pressure to be applied to the conduit body, which, in turn, assures a more effective and reliable fluid-tight connection and prolongs the service life of mechanically unstable refractory materials.

The provision of the pivotably mounted power cylinders 11 makes it possible to improve operating conditions of the herein proposed apparatus and to remove or more freely shift the tundish 2 relative to the conduits 5 along the framework 1.

Figure 3:
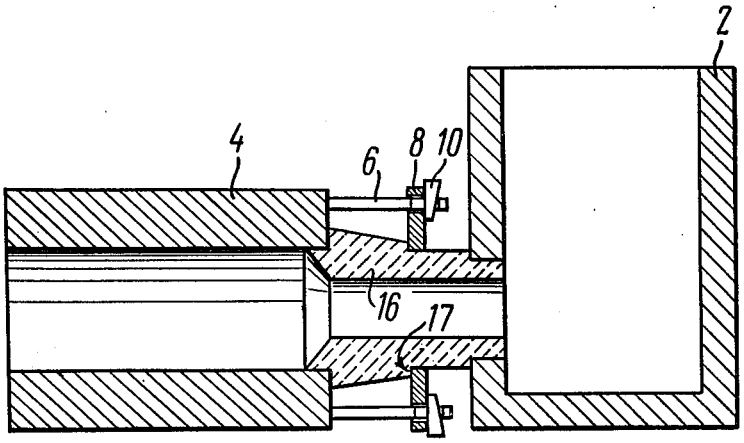
FIG. 3 is a cross sectional view similar to FIG. 2 of a simplified version of the strand unit shown in FIG. 1, provided with a single clasping ring.

One embodiment of the invention, wherein cylindrical conduits 5 such as shown in FIG. 3 are used, contemplates the provision of shoulder members 17 which are affixed on the outer surace of each said conduit and are adapted to engage the clasping rings 8. This version is well suited for application on inexpensive installations which are simple in operation and where there is no need for excessively high clamping pressures requiring reliable connection between conduits and molds.

Figure 4:
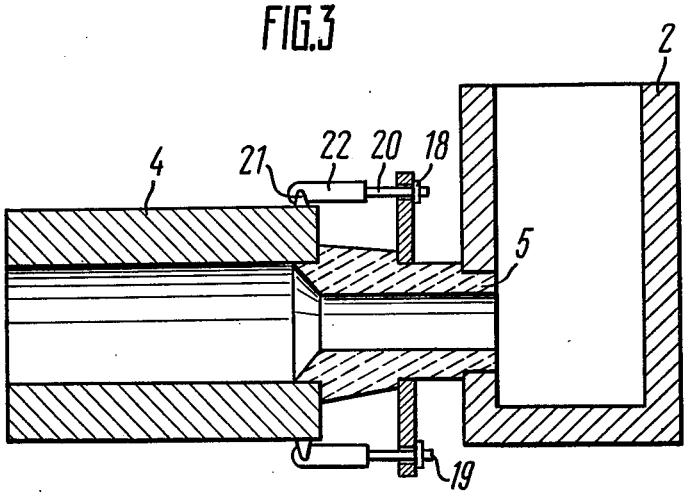
FIG. 4 is a cross sectional view similar to FIG. 2 showing an embodiment of the invention, wherein there is provided a screw-and-nut connection means which enables the clamping of a ring and a conduit to a mold, as well as hinged rods fitted on the mold outer surface.

In a number of cases, screw-and-nut joints are best suited as the means for adjusting clamping pressure applied to the ring 8 and the conduit to be clamped to the mold. In said means screw nuts 18, such as shown in FIG. 4, are screwed into externally threaded portions 19 of rods 20.

There is proposed herein still another embodiment of the present invention, which contemplates the fixing of the rods 20, whose working positions are in a parallel arrangement with each other, on hinges 21 provided on the end wall of the mold 4.

While particular embodiments of the invention have been shown and described, various modifications thereof will be apparent to those skilled in the art and, therefore, it is not intended that the invention be limited to disclosed embodiments or to the details thereof and the departures may be made therefrom within the spirit and scope of the invention as defined in the claims.

For example, it is possible to make use of individual power cylinders and other known power and clamping mechanisms for clamping rings 8 to conduits and further on to molds.

The continuous casting apparatus of the invention operates in the following manner.

A dummy bar 23 (see FIG. 1 and 2) is fed into the mold 4 by means of withdrawal rolls 24. A cylindrical casing of the refractory conduit 5 is fitted into the mold 4 and the clasping ring 8 is mounted through its holes on the rods 6 affixed to the mold 4.

Next, the cone-shaped distance piece or sleeve 7 is snugly fitted on the conduit 5 to protect the delicate body of the conduit from destruction when the conduit and the mold are clamped together to become leak-free. Effective protection of the conduit is made possible owing to the fact the clamping pressure is now applied uniformly throughout the entire surface of said conduit.

The herein described versions of fixing or connection means in the form of screw-and-nut fixing means and in the form of individual servocylinders 22, such as shown in FIG. 4, facilitate the assembly and precast preparation of the herein proposed apparatus.

The herein disclosed constructional arrangement of the continuous casting apparatus of the invention permits heating of the tundish 2 to be carried out separately from the molds 4. Thereafter, the tundish 2 is mounted on the carriage 3 and is moved by means of the power cylinders 11 towards the conduits 5 of each strand unit until said tundish is clamped tightly together with said conduits.

The molten metal is teemed from a ladle into the tundish 2 and is discharged therefrom into the horizontal molds through the conduits 5 wherein it solidifies to form the cast ingots which is then withdrawn from the mold by means of the withdrawal rolls 24.

The metal ingots produced by means of the continuous casting process exhibit an improved surface quality and are easily and conveniently withdrawn from the molds.

What is claimed is

1. A horizontal casting apparatus for continuously casting metals and alloys, including a frame, a tundish movable along said frame and in which molten metal is received, said tundish having a plurality of outlets for discharging parallel flows of molten metal, and a plurality of strand units, each of said strand units being connected to a respective outlet of said tundish, each of said strand units comprising:

a refractory conduit arranged horizontally at and communicating with a respective outlet of said tundish;

a horizontal mold communicating with said refractory conduit;

withdrawal rolls to withdraw cast ingots from said mold;

means for clamping said mold and said refractory conduit together associated with said mold and with said refractory conduit to effect fluid-tight connection between said mold and said refractory conduit, wherein said means for clamping comprises a plurality of rods in parallel arrangement with each other, said rods extending from said horizontal mold towards the conduit, a centrally disposed cone-shaped sleeve snugly fitted on a tapered outer surface of the conduit and serving as a distance piece between said horizontal mold and said tundish, said sleeve flaring towards said horizontal mold, a ring formed with holes around its periphery and clasping externally said sleeve, said ring being mounted by said rods being inserted through said holes on said periphery of said ring, the inner surface of said ring rigidly connected to the outer surface of said sleeve; and means for adjusting said means for clamping to adjust the pressure at which said conduit and said mold are clamped together.

2. A horizontal continuous casting apparatus as claimed in claim 1, wherein said means for adjusting comprises a plurality of adjuster cotters fitted into elongated slots provided on the ends of said rods, said cotters being used to shift said conduit through said ring towards said horizontal mold.

3. A horizontal continuous casting apparatus as claimed in claim 1, wherein said tundish is associated with said frame through a control power clamping mechanism being in articulated connection with said tundish to uniformly impart thereto a clamping pressure enabling closeness of contract between said tundish and the conduit of each of said strand units.

4. A horizontal continuous casting apparatus as claimed in claim 1, wherein said means for adjusting is made in the form of a screw-and-nut connection joint provided on an outer end of the parallel rods extending through the holes in the ring fitted around the conduit.

5. A horizontal continuous casting apparatus as claimed in claim 1, wherein said rods, extending away from the mold, are pivotably mounted on said mold at prescribed points along the perimeter of the end surface of the mold, said rods being readily pivoted to change their initial position which is that of parallel arrangement with each other and with the axis of the mold, said rods being provided with servocylinders for shifting the ends thereof relative to the end surface of the mold.

6. A horizontal casting apparatus as claimed in claim 1, wherein said tundish is made as an elongated vessel.

* * * * *